US005623798A

United States Patent [19]

Crews et al.

[11] Patent Number: 5,623,798

[45] Date of Patent: Apr. 29, 1997

[54] DEVICE FOR REDUCING STRESS AT RE-ENTRANT CORNERS OF A CONCRETE SLAB

[75] Inventors: Grant Crews, El Reno; Ben D. Fuller; Michael Caldarone, both of Edmond, all of Okla.

[73] Assignee: Dolese Bros. Co., Oklahoma City, Okla.

[21] Appl. No.: 543,244

[22] Filed: Oct. 13, 1995

[51] Int. Cl.[6] ..... E04B 1/16

[52] U.S. Cl. ..... 52/294; 52/287.1; 52/514

[58] Field of Search ..... 52/273, 244, 287.13, 52/288.1, 294, 329, 745.05, 514, 573.1, 749.13

[56] References Cited

U.S. PATENT DOCUMENTS

| | | | |
|---|---|---|---|
| 1,129,658 | 2/1915 | Foy . | |
| 1,458,034 | 6/1923 | Davin . | |
| 1,555,392 | 9/1925 | Tracy et al. | 52/273 |
| 1,979,206 | 10/1934 | Brand | 52/273 X |
| 2,111,922 | 3/1938 | Borkenstein | 52/273 X |
| 2,458,925 | 1/1949 | Barger | 52/273 X |
| 2,862,264 | 12/1958 | Perna | 52/287.1 |
| 2,940,152 | 6/1960 | Riehl . | |
| 2,953,835 | 9/1960 | Armstrong et al. . | |
| 3,107,087 | 10/1963 | Williams . | |
| 3,254,463 | 6/1966 | Moseley | 52/254 |
| 3,795,692 | 3/1974 | Argust . | |
| 3,854,692 | 12/1974 | Milton et al. . | |
| 5,203,640 | 4/1993 | Pourtau et al. | 52/287.1 X |
| 5,398,470 | 3/1995 | Ritter et al. . | |
| 5,475,953 | 12/1995 | Greenfield | 52/287.1 X |

FOREIGN PATENT DOCUMENTS

| | | | |
|---|---|---|---|
| 196609 | 3/1958 | Austria | 52/257 |

*Primary Examiner*—Michael Safavi
*Attorney, Agent, or Firm*—Dunlap & Codding, P.C.

[57] ABSTRACT

A stress reducing device for reducing or eliminating stress cracks in concrete slabs caused by shrinkage stresses at re-entrant corners of the concrete slab and method of use is provided. The stress reducing device is provided with a body member having a first and second leg, each leg having a first and second surface, the first surface of each leg defining an angle in the body member substantially corresponding to the angle of the re-entrant corner in a stem wall and the second surface of the first and second legs cooperating to define an arcuate concrete engaging surface for reducing concentration of stresses in the concrete slab adjacent the re-entrant corner.

11 Claims, 3 Drawing Sheets

DEVICE FOR REDUCING STRESS AT RE-ENTRANT CORNERS OF A CONCRETE SLAB

BACKGROUND OF THE INVENTION

1. Field Of The Invention

The present invention relates to a device for preventing stress cracks in concrete slabs, and more particularly but not by way of limitation, to a stress reducing device for preventing stress cracks produced by shrinkage stresses at re-entrant corners of a concrete slab. In one aspect, the present invention relates to a method for reducing stress concentration at a re-entrant corner so as to reduce crack formation in a concrete slab.

2. Brief Description Of The Prior Art

In the building industry one major problem which repeatedly occurs in concrete slabs is the formation of stress cracks at re-entrant corners (i.e., inside corners). Stress cracks occur in concrete slabs as shrinkage stresses increase at re-entrant corners of the concrete slab. That is, as the magnitude of the change in direction of stress increases, the stress concentration at the re-entrant corners of a concrete slab which results in a high incidence of cracks in the slab at re-entrant corners also increases. To reduce stress cracks at the re-entrant corners of a concrete slab, concrete finishers have heretofore chipped the re-entrant corners of a concrete slab in an effort to reduce the sharp edge of the re-entrant corners. While such technique has at times reduced or minimized the formation of stress cracks at re-entrant corners of a concrete slab, such technique is time consuming and has not proven satisfactory in substantially eliminating, on a consistent basis, the formation of cracks at the re-entrant corners of a concrete slab. Therefore, it would be desirable if the shrinkage stresses of the concrete at re-entrant corners of a concrete slab could be effectively reduced or redistributed and thereby substantially eliminate re-entrant corner stress cracks in a concrete slab.

SUMMARY OF THE INVENTION

In accordance with the present invention, a stress reducing device is provided for reducing or redistributing shrinkage stresses at re-entrant corners of a concrete slab whereby stress cracks at re-entrant corners of a cement slab are effectively eliminated. The stress reducing device includes a body member having a first leg and a second leg. The first leg is provided with a first surface and an opposed second surface; and the second leg is provided with a first surface and a second surface. The first surface of the first leg cooperates with the first surface of the second leg to define an angle therebetween which substantially corresponds to the angle of a re-entrant corner. The second surface of the first leg and the second surface of the second leg cooperate to define an arcuate concrete engaging surface. Thus, when employing the stress reducing device to define a re-entrant corner of a concrete slab, the arcuate concrete engaging surface of the body member effectively reduces stress concentration developed at the re-entrant corner and thereby retards crack formation in the concrete slab at the re-entrant corner.

The present invention also relates to a method for reducing stress cracking at a re-entrant corner of a concrete slab by effectively reducing shrinkage stress concentration at the re-entrant corner of a concrete slab. To effectively reduce cracking at the re-entrant corner of the concrete slab, a stress reducing device is positioned along an interior surface of a form or stem wall defining a re-entrant corner so that the angle formed between the first and second legs of the body member is disposed substantially adjacent the angle produced by the form or stem wall defining the re-entrant corner and the arcuate concrete engaging surface of the body member is disposed in a concrete engaging position. Thus, upon pouring concrete into the confined area defined by the form or stem wall, the arcuate concrete engaging surface of the body member of the stress reducing device produces an arcuate shaped re-entrant corner which effectively reduces the concentration of stresses in the concrete slab at the re-entrant corner and thereby reduces development of cracks in the concrete slab adjacent the re-entrant corner.

An object of the present invention is to reduce stress cracking at re-entrant corners of a concrete slab.

Another object of the present invention, while achieving the before-stated object, is to provide a stress reducing device capable of reducing stress cracking at a re-entrant corner of a concrete slab which is economical to manufacture and which can readily be employed in combination with forms, stem walls, or combinations thereof defining the re-entrant corner.

Yet another object of the present invention, while achieving each of the above-stated objects, is to provide a method for reducing cracking at a re-entrant corner of a concrete slab by reducing shrinkage stresses at the re-entrant corner.

Other objects, advantages and features of the present invention will become apparent upon reading of the following detailed description in conjunction with the appended claims.

DETAILED DESCRIPTION

Figure 1:
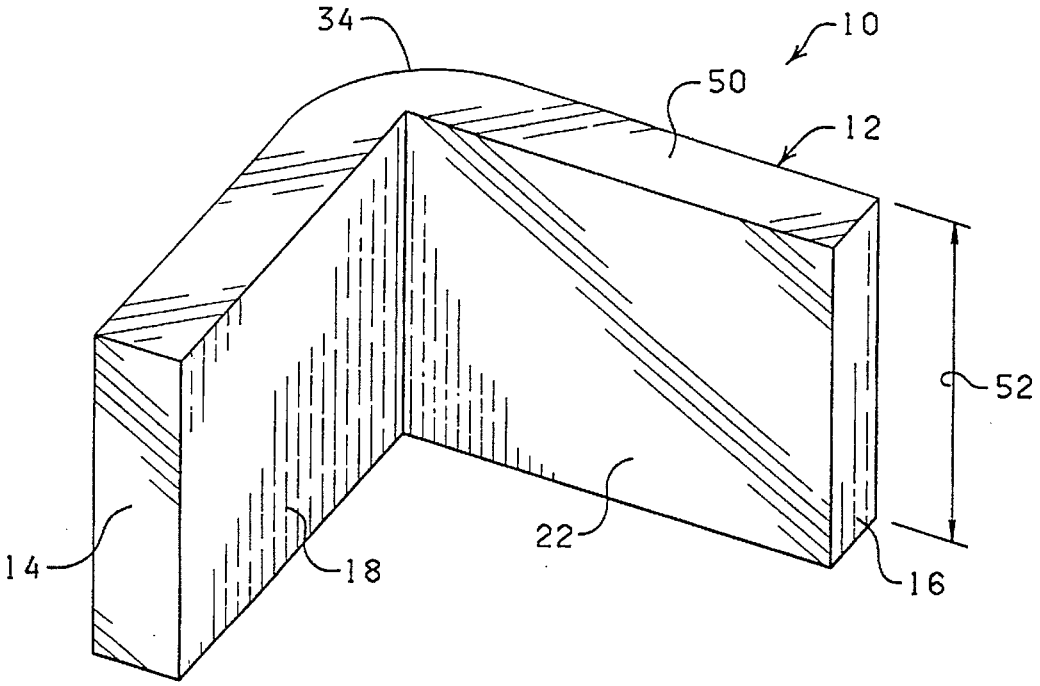
FIG. 1 is a perspective view of a stress reducing device for reducing stress cracking at a re-entrant corner of a concrete slab constructed in accordance with the present invention.
Figure 2:
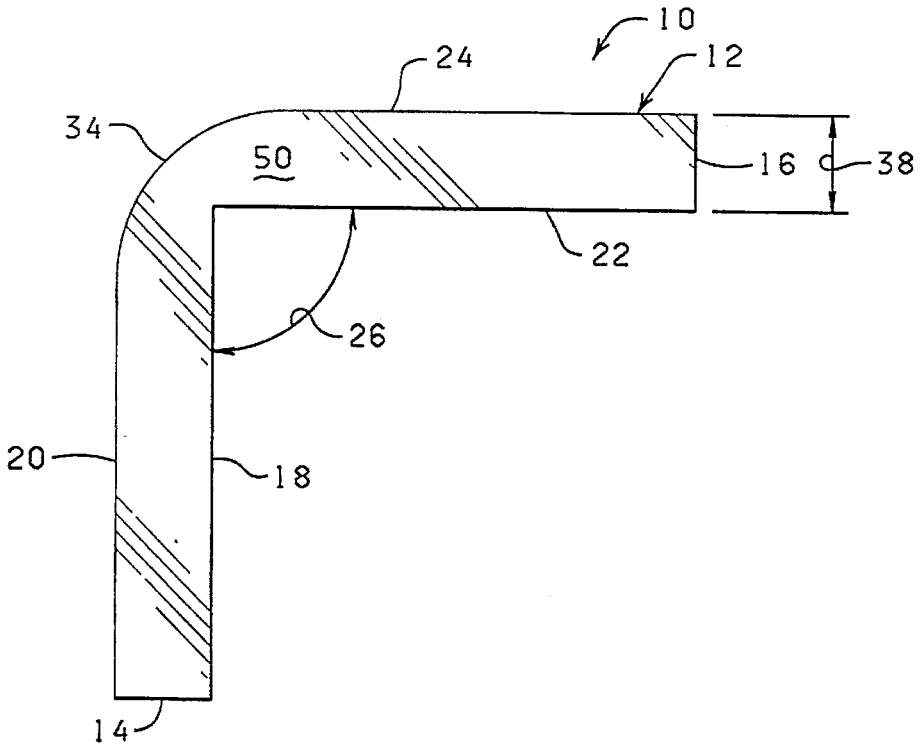
FIG. 2 is a top plan view of the stress reducing device of FIG. 1.

Referring now to the drawings, and more particularly to FIGS. 1 and 2, shown therein is a stress reducing device 10 constructed in accordance with the present invention which, when embedded in a concrete slab at a re-entrant corner thereof, substantially eliminates crack formation at a re-entrant corner of a concrete slab by reducing stress concentrations in the concrete slab at the re-entrant corner due to shrinkage stresses. The stress reducing device 10 comprises a body member 12 having a first leg 14 and a second leg 16. The first leg 14 is provided with a first surface 18 and an opposed second surface 20 (FIG. 2); and the second leg 16 is provided with a first surface 22 and an opposed second surface 24 (FIG. 2). The first surface 18 of the first leg 14 and the first surface 22 of the second leg 16 cooperate to define an angle 26 therebetween which substantially corresponds to a re-entrant corner 28 defined by a stem wall 30 (FIG. 3) or a re-entrant corner 28*a* defined by a form 32 (FIG. 5). The second surface 20 of the first leg 14 and the second surface 24 of the second leg 16 cooperate to define an arcuate concrete engaging surface 34 which, when employed in the formation of the re-entrant corner 28 of a concrete slab 36 (FIG. 4) or the re-entrant corner 28*a* of a concrete slab 36*a* (FIG. 6) substantially reduces the concentration of stresses at the re-entrant corners 28 and 28*a* of the concrete slabs 36 and 36*a*, respectively, and thereby reduces the development of cracks in the concrete slabs 36 and 36*a* adjacent the re-entrant corners 28 and 28*a*.

The first and second legs 14 and 16 of the body member 12 are provided with a thickness 38 so that the arcuate concrete engaging surface 34 is disposed a distance from a first portion 40 and second portion 42 of the stem wall 30 (FIGS. 3 and 4) defining the re-entrant corner 28, or a distance from a first portion 44 and a second portion 46 of the form 32 (FIG. 5) defining the re-entrant corner 28*a*.

The radius of the arcuate concrete engaging surface 34 of the body member 12 can vary widely, the only requirement being that the radius of the arcuate concrete engaging surface 34 is sufficient to reduce stress concentrations in the concrete slabs 36 and 36*a* at the re-entrant corners 28 and 28*a* thereof. Generally, desirable results can be obtained when the arcuate concrete engaging surface 34 of the body member 12 has a radius of at least about 1 inch, and more desirably, a radius of from about 1 to about 3 inches.

The body member 12 is further characterized as having an upwardly extending edge 50 and a height 52. The height 52 of the body member 50 can vary provided the height 52 is sufficient so that upon connecting the body member 12 to either the stem wall 30 (FIG. 3) or to the form 32 (FIG. 5), the height 52 of the body member 12 substantially corresponds to the depth of the concrete slabs 36, 36*a* and the upwardly extending edge 50 of the body member 12 is substantially co-planar with an upper surface 54 of the stem wall 30 or an upper surface 56 of the form 32 substantially as shown in FIGS. 3 and 5.

The body member 12 of the stress reducing device 10 can be fabricated of any material capable of being affixed to the stem wall 30 or the form 32 and which will maintain its structural integrity when concrete is poured into the confined area defined by the stem wall 30 or the form 32 to form the concrete slabs 36 and 36*a*. However, desirable results have been obtained wherein the body member 12 is constructed of STYROFOAM, an expanded, substantially rigid polystyrene plastic.

Figure 3:
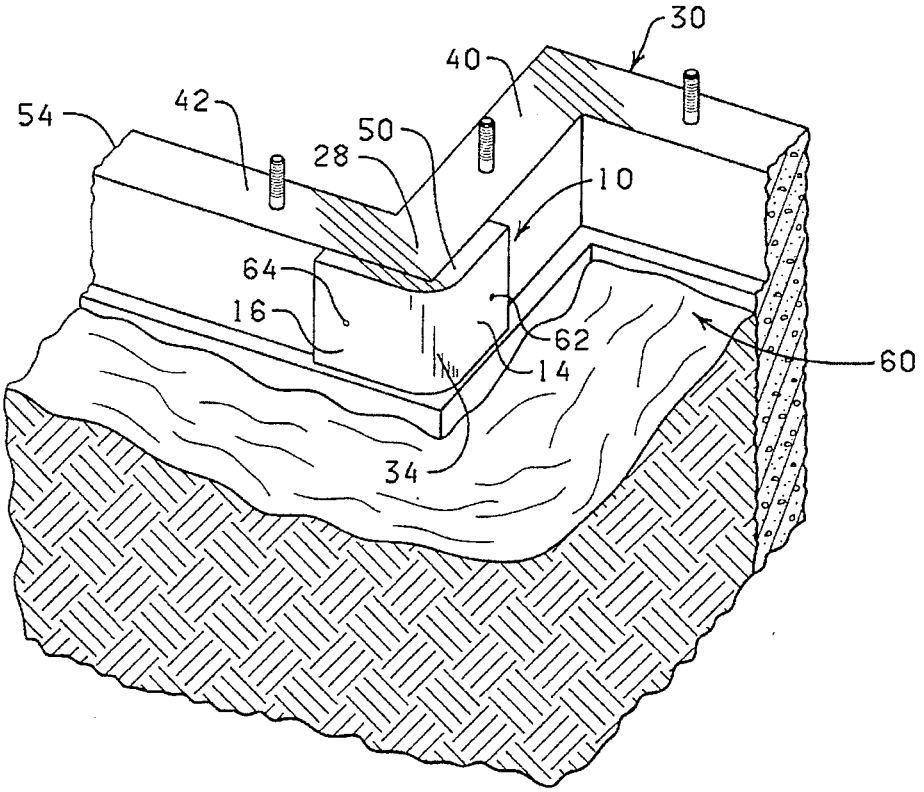
FIG. 3 is a fragmental, perspective view illustrating the stress reducing device of FIG. 1 connected to a portion of a stem wall defining a re-entrant corner.
Figure 4:
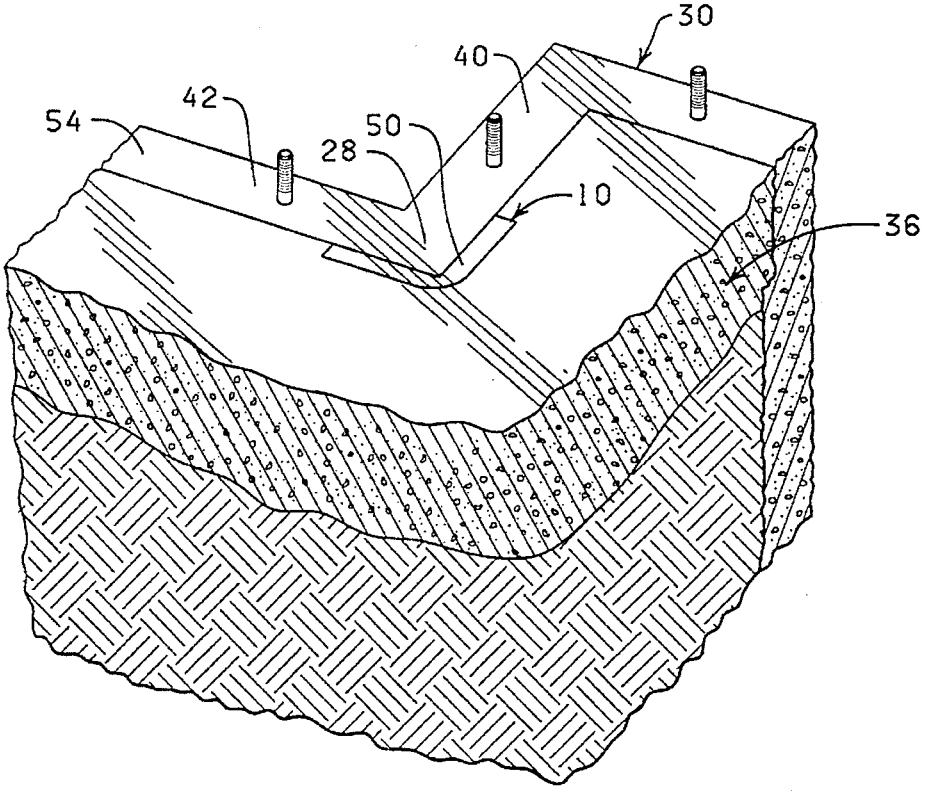
FIG. 4 is a fragmental, perspective view illustrating the stress reducing device of FIG. 1 embedded in a concrete slab at a re-entrant corner thereof.
Figure 5:
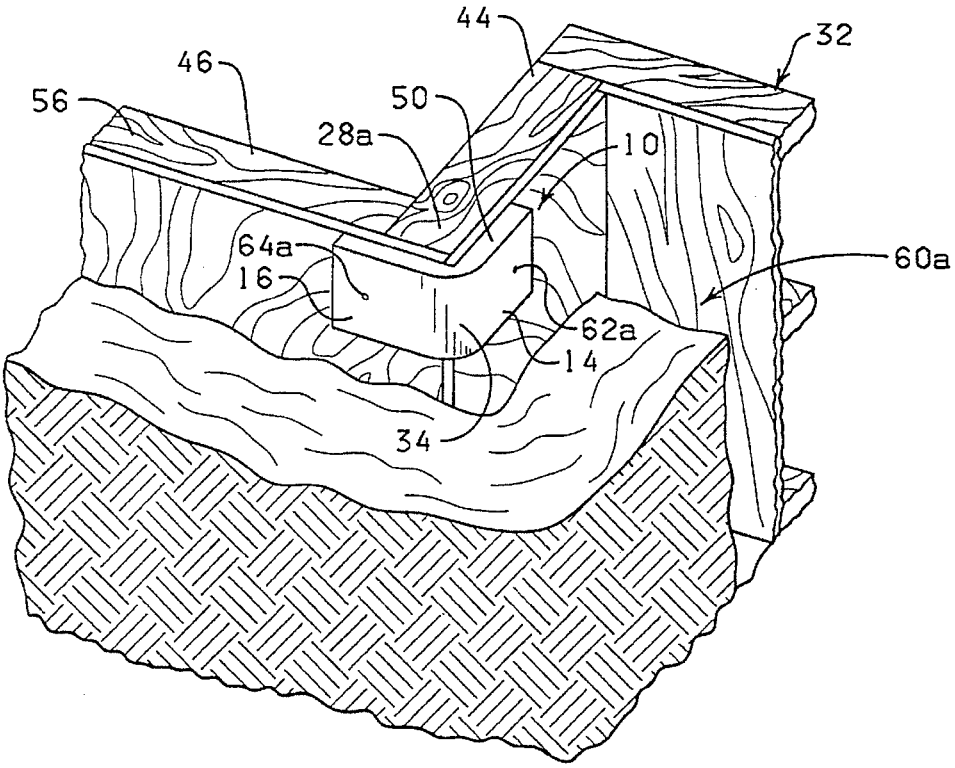
FIG. 5 is a fragmental, perspective view illustrating the stress reducing device connected to a portion of a form defining a re-entrant corner.

Referring now to FIGS. 3–6, a method for reducing cracking at the re-entrant corner 28 and 28*a* of the concrete slabs 36 and 36*a* by utilizing the stress reducing device 10 will now be described in more detail. In FIGS. 3 and 4 the stem wall 30 is formed employing conventional techniques so as to define a confined area 60 into which concrete is poured to produce the concrete slab 36. The stem wall 30 is provided with at least one re-entrant corner, such as the re-entrant corner 28 formed by the first portion 40 and the second portion 42 of the stem wall 30. Prior to pouring concrete into the confined area 60 to produce the concrete slab 36, the stress reducing device 10 is disposed adjacent the re-entrant corner 28 substantially as shown in FIG. 3. That is, the first surface 18 of the first leg 14 of the body member 12 is disposed substantially adjacent the first portion 40 of the stem wall 30 and the first surface 22 of the second leg 16 of the body member 12 is disposed substantially adjacent the second portion 42 of the stem wall 30 such that the angle formed by the first surfaces 18 and 22 of the first and second legs 14 and 16 of the body member 12 substantially conforms with the angle formed by the re-entrant corner 28 and is disposed in a substantially abutting relationship therewith. The body member 12 is then secured to the stem wall 30 in a conventional manner, such as with nails 62 and 64, whereby upon pouring concrete into the confined area 60 defined the stem wall 30 the arcuate concrete engaging surface 34 of the body member 12 of the stress reducing device 10 is exposed to the concrete and the body member 12 becomes embedded in the concrete slab 36. It has been found that by embedding the stress reducing device 10 in the concrete slab 36 at the re-entrant corner 28 (FIG. 4), the concentration of stresses in the concrete slab 36 adjacent the re-entrant corner 28 is substantially reduced thereby eliminating development of cracks in the concrete slab 36 adjacent the re-entrant corner 28.

Figure 6:
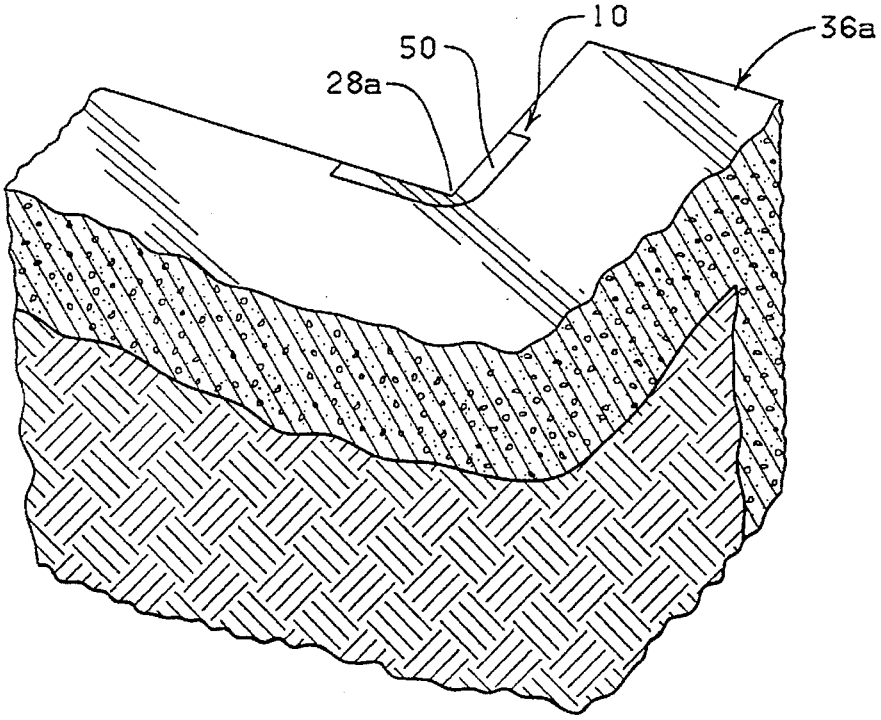
FIG. 6 is a fragmental, perspective view illustrating the stress reducing device embedded in a concrete slab at a re-entrant corner thereof.

In FIGS. 5 and 6 the form 32 is formed employing conventional techniques so as to define a confined area 60*a* into which concrete is poured to produce the concrete slab 36*a*. The form 32 is provided with at least one re-entrant corner, such as the re-entrant corner 28*a* formed by the first portion 44 and the second portion 46 of the form 32. Prior to pouring concrete into the confined area 60*a* to produce the concrete slab 36*a*, the stress reducing device 10 is disposed adjacent the re-entrant corner 28*a* substantially as shown. That is, the first surface 18 of the first leg 14 of the body member 12 is disposed substantially adjacent the first portion 44 of the form 32 and the first surface 22 of the second leg 16 of the body member 12 is disposed substantially adjacent the second portion 46 of the form 32 such that the angle formed by the first surfaces 18 and 22 of the first and second legs 14 and 16 of the body member 12 substantially conforms with the angle formed by the re-entrant corner 28*a* and is disposed in a substantially abutting relationship therewith. The body member 12 is then secured to the form 32 in a conventional manner, such as with nails 62*a* and 64*a*, whereby upon pouring concrete into the confined area 60*a* defined by the form 32, the arcuate concrete engaging surface 34 of the body member 12 of the stress reducing device 10 is exposed to the concrete and the body member 12 becomes embedded in the concrete slab 36*a*. When the concrete slab 36*a* is sufficiently cured, the form 32 is removed leaving the stress reducing device 10 embedded in the concrete slab 36*a* at the re-entrant corner 28*a* substantially as shown in FIG. 6. It has been found that by embedding the stress reducing device 10 in the concrete slab 36*a* at the re-entrant corner 28*a*, the concentration of stresses in the concrete slab 36*a* adjacent the re-entrant corner 28*a* is substantially reduced thereby eliminating development of cracks in the concrete slab 36*a* adjacent the re-entrant corner 28*a*.

As previously stated, the height 52 of the body member 12 substantially corresponds to the depth of the concrete slabs 36, 36*a* so that in a connected position the upwardly extending edge 50 of the body member 12 is substantially co-planar with an upper surface 54 of the stem wall 30 or an upper surface 56 of the form 32 substantially as shown in FIGS. 3 and 5. Because the depth of the concrete slabs 36 and 36*a* may vary, a portion of the body member 12 may extend upwardly from the upper surface 54 of the stem wall 30 or the upper surface 56 of the form 32. In such event, the portion of the body member 12 extending above the upper surface 54 or the stem wall 30 or the upper surface 56 of the form 30 is cut off so that the upwardly extending edge 50 of the body member 12 is substantially co-planar with the upper surface 54 of the adjacently disposed portions of the stem wall 30 or of the form 32. Thus, the body member 12 of the stress reducing device 10 will be provided with a height substantially corresponding to the depth of the concrete slab 36 or 36*a* produced by pouring concrete into the confined areas 60 and 60*a* defined by the stem wall 30 or the form 32.

Changes may be made in the construction and the operation of the various components, elements and assemblies described herein and changes may be made in the steps or the sequence of steps of the methods described herein without departing from the spirit and scope of the invention as defined in the following claims.

What is claimed:

1. A concrete slab poured within the confines of a stem wall in combination with a stress reducing device for preventing cracks in the concrete slab, a first portion and a second portion of the stem wall defining a re-entrant corner, the stress reducing device comprising:

a body member having a first leg and a second leg, the first leg having a first surface and an opposed second surface and the second leg having a first surface and an opposed second surface, the first surface of the first leg and the first surface of the second leg defining an angle in the body member substantially corresponding to the angle of the re-entrant corner in the stem wall and the second surface of the first leg and the second surface of the second leg cooperating to define an arcuate concrete engaging surface, the body member embedded in the concrete slab with the first surface of the first leg disposed substantially adjacent the first portion of the stem wall and the first surface of the second leg disposed substantially adjacent the second portion of the stem wall such that the angle formed by the first surfaces of the first and second legs substantially conforms with the angle formed by the re-entrant corner in the stem wall in a substantially abutting relationship therewith and such that the arcuate concrete engaging surface is exposed to the concrete slab so as to reduce the concentration of stresses in the concrete slab adjacent the re-entrant corner and thereby reduce the development of cracks in the concrete slab adjacent the re-entrant corner.

2. The combination of claim 1 wherein the first and second legs of the body member are provided with a thickness such that the arcuate concrete engaging surface is disposed a distance from the first and second portions of the stem wall defining the re-entrant angle.

3. The combination of claim 2 wherein the arcuate concrete engaging surface of the body member has a radius of at least about 1 inch.

4. The combination of claim 3 wherein the body member is constructed of an expanded, substantially rigid polystyrene plastic.

5. The combination of claim 2 wherein the arcuate concrete engaging surface of the body member has a radius of from about 1 to about 3 inches.

6. The combination of claim 5 wherein the body member is constructed of an expanded substantially rigid polystyrene plastic.

7. A concrete slab poured within the confines of a concrete retaining form in combination with a stress reducing device for decreasing shrinkage stress of the concrete slab so as to prevent formation of cracks, a first portion and a second portion of the concrete retaining form defining a re-entrant corner, the stress reducing device comprising:

a body member having a first leg and a second leg, the first leg having a first surface and an opposed second surface and the second leg having a first surface and an opposed second surface, the first surface of the first leg and the first surface of the second leg defining an angle in the body member substantially corresponding to an angle of the re-entrant corner of the concrete retaining form and the second surface of the first leg and the second surface of the second leg cooperating to define an arcuate concrete engaging surface, the body member embedded in the concrete slab with the first surface of the first leg substantially corresponding to the first portion of the concrete retaining form and the first surface of the second leg substantially corresponding to the second portion of the concrete retaining form such that the angle formed by the first surfaces of the first and second legs substantially conforms with the angle formed by the re-entrant corner of the concrete retaining form and such that the arcuate concrete engaging surface is exposed to the concrete slab so as to reduce the concentration of stresses in the concrete slab adjacent the re-entrant corner and thereby reduce the development of cracks in the concrete slab adjacent the re-entrant corner.

8. The combination of claim 7 wherein the arcuate concrete engaging surface of the body member has a radius of at least about 1 inch.

9. The combination of claim 8 wherein the body member is constructed of an expanded, substantially rigid polystyrene plastic.

10. The combination of claim 7 wherein the arcuate concrete engaging surface of the body member has a radius of from about 1 to about 3 inches.

11. The combination of claim 10 wherein the body member is constructed of an expanded, substantially rigid polystyrene plastic.

* * * * *